US006289807B1

(12) United States Patent
Kutzner et al.

(10) Patent No.: US 6,289,807 B1
(45) Date of Patent: Sep. 18, 2001

(54) OPEN, PRESSURELESS INK DUCT HAVING A LOW SURFACE ENERGY COATING TO AID IN FORMING A ROLL OF INK

(75) Inventors: Willi Albert Peter Kutzner; Wolfgang Günther Ruckmann, both of Würzburg; Karl Robert Schäfer, Rimper; Georg Schneider, Würzburg, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/284,488

(22) PCT Filed: Oct. 17, 1997

(86) PCT No.: PCT/DE97/02398

§ 371 Date: Apr. 23, 1999

§ 102(e) Date: Apr. 23, 1999

(87) PCT Pub. No.: WO98/18631

PCT Pub. Date: May 7, 1998

(30) Foreign Application Priority Data

Oct. 25, 1996 (DE) ..... 196 44 371
Jun. 13, 1997 (DE) ..... 197 25 056

(51) Int. Cl.[7] ..... B41F 31/00; B41F 1/40

(52) U.S. Cl. ..... 101/350.1; 101/350.6; 101/207

(58) Field of Search ..... 101/49, 148, 204, 101/207, 208, 210, 315, 321, 326, 330, 331, 340, 344, 347, 350.1, 356, 360, 363, 364–367, 350.6

(56) References Cited

U.S. PATENT DOCUMENTS

| | | | | |
|---|---|---|---|---|
| 3,318,239 | | 5/1967 | Wintzer | 101/364 |
| 3,884,868 | * | 5/1975 | Trice et al. | 260/37 N |
| 4,070,964 | | 1/1978 | Vertegaal | 101/120 |
| 4,252,859 | * | 2/1981 | Concannon et al. | 428/422 |
| 4,565,714 | * | 1/1986 | Koshar | 427/515 |
| 4,838,164 | | 6/1989 | Miyoshi et al. | 101/365 |
| 4,929,666 | * | 5/1990 | Schmidt et al. | 524/516 |
| 5,027,513 | | 7/1991 | Allison, Jr. | 30/169 |
| 5,061,769 | * | 10/1991 | Aharoni | 526/245 |
| 5,119,728 | | 6/1992 | Rogge | 101/363 |
| 5,243,907 | | 9/1993 | Weishew | 101/208 |
| 5,290,900 | * | 3/1994 | Kabayashi | 538/26 |
| 5,520,110 | | 5/1996 | Tittgemeyer | 101/363 |
| 5,671,673 | | 9/1997 | Boose et al. | 101/363 |
| 5,851,683 | * | 12/1998 | Plamthottam et al. | 428/519 |

FOREIGN PATENT DOCUMENTS

| | | |
|---|---|---|
| 43 30 047 | 9/1993 | (DE) . |
| 4401 365 | 1/1994 | (DE) . |
| 295 19 531 | 2/1995 | (DE) . |
| 0 246 708 | 5/1987 | (EP) . |
| 0 663 289 | 1/1995 | (EP) . |
| 0 732 205 | 1/1996 | (EP) . |
| 61283545 | 12/1986 | (JP) . |
| 63286349 | 11/1988 | (JP) . |
| 9300810 | 5/1993 | (NL) . |
| WO 93/24328 | 12/1993 | (WO) . |

OTHER PUBLICATIONS

Bull, S. J., Tribology of Carbon Coatings: DLC, Diamond and Beyond, Diamond and Related Materials, Bd. 4, Nr. 5–6, May 1, 1995, pp. 827–836.

Deng J. et al., DLC Multilayer Coatings for Wear Protection, Diamond and Related Materials, Bd. 4, Nr. 7, May 15, 1995, pp. 936–943.

* cited by examiner

*Primary Examiner*—Kimberly L. Asher
(74) *Attorney, Agent, or Firm*—Jones, Tullar & Cooper, PC

(57) ABSTRACT

An ink duct for a rotary printing press wherein all or some of the surfaces of the ink duct are permanently coated with a substance which has a low surface energy of between 10 and 60 mN/m. As well as enabling the ink duct to be cleaned easily, the blending of the printing ink is improved owing to the reduced frictional resistance of the coated parts, which in turn leads to more uniform use of the ink-metering roller.

28 Claims, 2 Drawing Sheets

OPEN, PRESSURELESS INK DUCT HAVING A LOW SURFACE ENERGY COATING TO AID IN FORMING A ROLL OF INK

FIELD OF THE INVENTION

The present invention relates to an ink duct for an ink unit of a rotary printing press. The ink duct has ink metering elements with all or selected surfaces coated with a substance of low surface energy.

DESCRIPTION OF THE PRIOR ART

U.S. Pat. No. 5,027,513 discloses a doctor blade made from PTFE.

In EP 07 32 205 A1, an ink duct bottom of an ink duct is coated with PTFE.

U.S. Pat. No. 4,070,964 shows a doctor blade coated with Teflon for reducing the friction between the doctor blade and the screen.

EP 02 46 708 A1 and NL-A 9300810 describe doctor blades coated with Teflon.

DE 43 30 047 A1 describes an applicator unit for applying highly viscous inks. This ink is formed into an ink roll. For improving the transfer of the ink to the receiving roller, compressed air is blown into the ink roll.

EP 06 63 289 A1 shows a closed ink chamber, whose interior is cylindrically designed for forming an ink roll in connection with low-viscosity inks.

SUMMARY OF THE INVENTION

The object of the present invention is directed to creating an ink duct.

In accordance with the present invention, this object is attained by providing an ink duct which includes ink metering elements. All or selected surfaces of the ink duct and/or the ink material elements are coated with a substance of low surface energy.

The advantages which can be achieved by means of the present invention in particular rest in that because of the coating of the inside of the ink duct as well as the coating of the metering elements, the surface energy and therefore the surface tension and therefore the frictional resistance to ink has been greatly reduced in respect to all surfaces which come into contact with the ink. Not only is the cleaning of the elements coming into contact with the ink possible, without effort, the ink can be better intermixed because of the reduced frictional resistance of the coated elements. Moreover, a so-called "ink roll formation" in the ink duct is furthered. This "ink roll formation" results in a more even wetting of the ink metering roller.

BRIEF DESCRIPTION OF THE DRAWINGS

Preferred embodiments of the present invention are represented in the drawings and will be described in greater detail in what follows. Shown are in.

DESCRIPTION OF THE PREFERRED EMBODIMENTS

Figure 1:
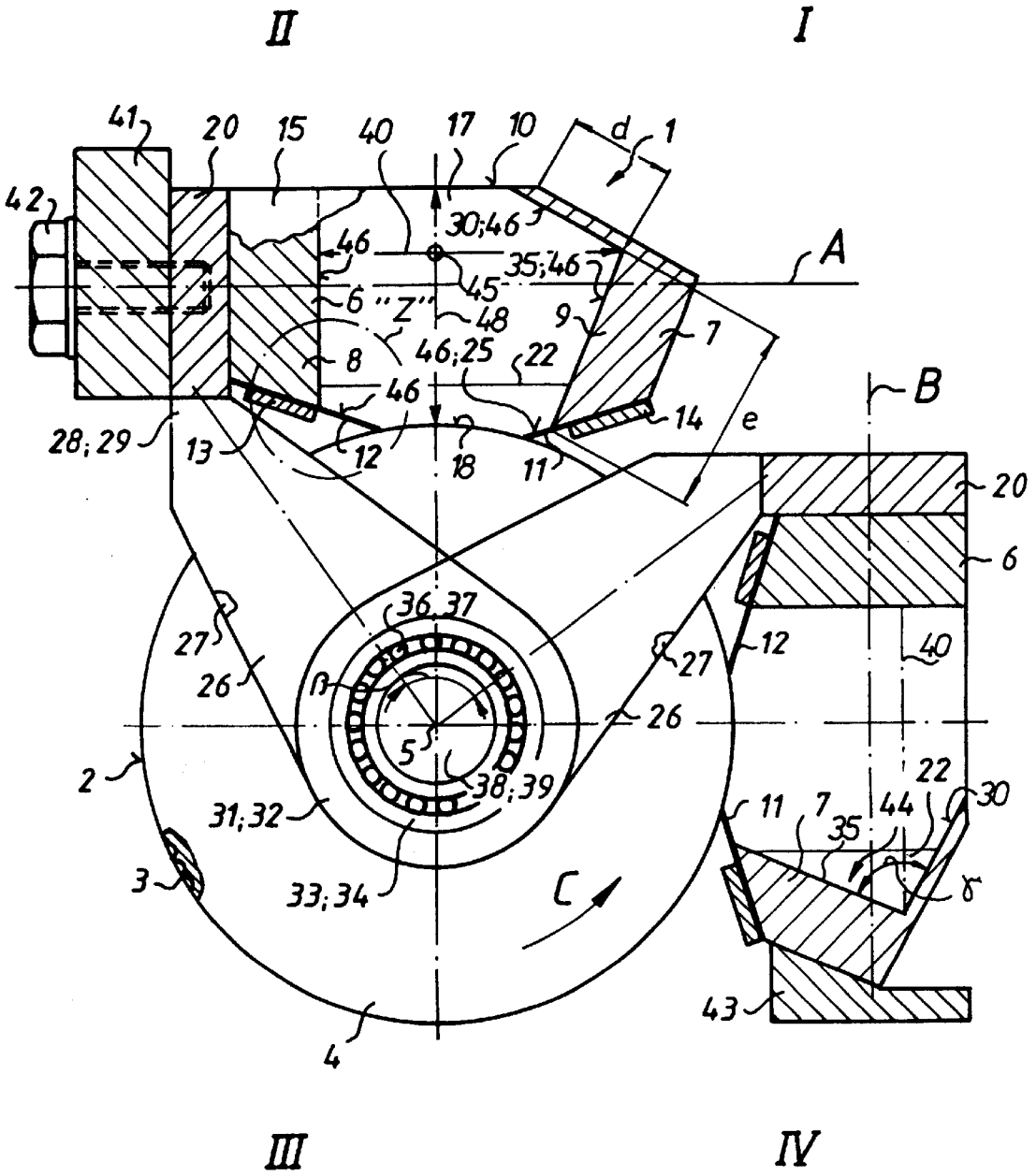
FIG. 1, a schematic representation of a cross section through an ink duct arranged above a screen roller in the working position and the resting position, with doctor blades; and in FIG. 2, an enlarged schematic representation of a detail "Z" in FIG. 1.

A pivotable ink duct 1 with doctor blades in accordance with the present invention, and with a working doctor blade 12 and a closing doctor blade 11, is arranged in its working position A, on the top of an ink metering roller 4, as is shown in FIG. 1. The ink metering roller 4 has small cups 3 or depressions in its surface 2 and is thus typically identified as a screen roller or a screen surface roller.

Viewed in the production direction C, the closing doctor blade 11 has been positively placed against the ink metering roller 4.

Viewed in the production direction C, the working doctor blade 12 has been negatively placed against the ink metering roller 4 at a negative angle $\alpha$ with respect to a line 16 tangent to the surface 2 of the roller 4 at the contact point between the closing doctor blade 11 and the roller 4.

The ink duct 1 includes a left lateral wall 6, and a right lateral wall 7, which walls 6 and 7 extend in an axis-parallel direction in respect to the ink metering roller 4 and which are spaced apart from each other. Depending on the intended pivot direction, the left, 6, and/or the right lateral wall 7 is angled toward the interior at a sufficient height and extending over the entire width of the ink duct 1.

Each of the right/left lateral walls 7, 6 extends downward from its upper edge 10, so that the inside width of the ink duct 1 increases, approximately to half the height of the ink duct 1, and thereafter narrows again in the portion located underneath. By means of this, a channel 44 is formed at the lowest point in the draining position B of the ink duct 1, into which the ink 22 runs and into which the ink 22 is received. The lateral walls 6, 7 extend, when the ink duct 1 is in its working position A, from an upper edge 10 downwardly in the direction toward their lower doctor blade mounting surface 8, 9 facing the ink metering roller 4. On these mounting surfaces 8, 9, doctor blades 11, 12 are held by means of clamping strips 13, or respectively 14. This structure may be seen in both FIGS. 1 and 2.

End walls 15, 17 have been attached to both sides of the ends of the lateral walls 6, 7. The lower side 18 of each end wall 15, 17, facing the ink metering roller 4, has been matched to the contour of the surface 2 of the ink metering roller 4. In its draining position B, the ink duct 1 can be pivoted, for example by the angle $\beta$=70° to 110°, around the axis of rotation 5 of the ink metering roller 4. In this case, the doctor blades 11 and 12 remain in contact with the surface 2 of the ink metering roller 4. The ink duct 1—viewed in its work position A—is open at the top.

The ink duct 1 can be fastened on a cross bar 20, for example by means of its lateral wall 6, on the lateral frames of the machine.

In a further preferred embodiment, both ends of the cross bar 20 of the ink duct 1 are fastened on each one of the ends 28, or respectively 29, of a pivot arm 26, or respectively 27. The second ends 31, 32 of the pivot arms 26, 27 are each pivotably seated on a bearing bush 33, 34, fixed on the lateral frames. Via a rolling bearing 36, 37, each bearing bush 33, 34 receives an axle journal 38, 39 of the ink metering roller 4. By means of the steps just described, the ink duct 1 can be pivoted around the axis of rotation 5 of the ink metering roller 4.

In its top, or respectively work position A, the ink duct 1 is moved directly or indirectly into contact against a stop 41 fixed in place on the lateral frames by means of the cross bar 20 fastened on the pivot arms 26, 27, and is locked or fixed in place against stop 41 by means of screws 42. After unlocking, the horizontal ink duct 1 can be laterally pivoted from its work position A on the top of the ink metering roll 4 into a draining position B. In the process, the doctor blades 11 and 12 remain in contact with the circumferential surface 2 of the ink metering roller 4. The pivot angle β of the ink duct 1 can lie between 70 and 110°. The pivot movement of the ink duct downward is limited, for example, by a stop 43 fixed in place on the lateral frame. The right lateral wall 7 of the ink duct 1 then rests against stop 43 and is held by it, or respectively is locked to it.

In the process, the ink 22 is collected in a channel 44, open at the top, of the lateral wall 7, which now is in a horizontal position, as shown in FIG. 1.

The ink duct 1 can be embodied to be easily removable, preferably from the press, in the horizontal draining position B, i.e. it can be releasable from the cross bar 20. For this purpose, the left lateral wall 6, for example, can be embodied to be guided by means of a linear guide, not specifically shown, in the cross bar 20 and can be fixed in place.

When the ink duct 1 has been removed from the press, the ink duct 1, as well as the ink metering roller 4, can be easily cleaned.

The achievement of pivoting of the ink duct 1 is not limited to the above described means. It is also possible to pivot the ink duct 1 from the position A to the position B and back by other mechanical means.

For example, the front walls 15, 17 could each be provided with stud bolts, wherein the stud bolts are guided in curved guides fixed on the lateral frames.

The ink metering elements 11, 12, for example ink blades, ink blade lamellas, doctor blades, and the like can be arranged and fastened on the underside of the ink duct 1, as previously discussed. The doctor blades 11 and 12 are used as working doctor blades 12 and as closing doctor blades 11.

In order to make "rolling" of, for example, highly viscous ink such as, for example so-called "UV ink", easier in the ink duct 1, and in this way to make possible improved inking of the ink metering roller 4, the interior of the ink duct 1, namely the lateral walls 6, 7, the front walls 15, 17, as well as the ink metering elements, i.e. the doctor blades 11, 12, can be permanently coated with a substance 46, whose surface energy has a lower value, for example between 10 and 60 nM/m. Such substances, for example, are PTFE, or metal-free amorphous carbon coatings "a-C:H" also called "DLC" coatings or diamond-like carbon coatings. These amorphous carbon coatings consist of a highly cross-linked carbon network, on which hydrogen has been deposited. The surface energy of the DLC coatings, and thereby the wetting behavior, the hardness and the wear, can be selectively affected by a modification of the network structure of fluorine (F), silicon (Si), oxygen (O) and nitrogen (N) and the percental fractions.

Besides PTFE, it is also possible to use DCL+fluorine (F-DLC), DLC+silicon (Si-DLC), DLC+oxygen (O-DLC) and DLC+nitrogen (N-DLC) and DLC+boron (B-DLC).

In accordance with a further preferred embodiment, the coating substance 46 of low surface energy can consist of hydrocarbon polymers, in particular of poly(propylene), or poly(styrene), and copolymers.

Furthermore the coating substance 46 of low surface energy can consist of styrene polymers, in particular poly (styrene-stat-2,2,3,3-tetrafluoropropyl methacrylate).

Furthermore, the substance 46 of low surface energy can consist of halogen hydrocarbon polymers, in particular poly(chlorotrifluoroethylene), or poly (chlorotrifluoroethylene-stat-tetrafluoroethylene), or poly (hexafluoropropylene), or poly(tetrafluoroethylene), or poly (tetrafluoroethylene-stat-ethylene), or poly (trifluoroethylene).

Furthermore, the coating substance 46 of low surface energy can consist of vinyl polymers, in particular of poly ((heptafluoroiso-propoxy)ethylene)methyl), or poly(1-(heptafluoroisopropoxy)methyl).

Furthermore, the substance 46 of low surface energy can consist of fluoridated acrylic polymers, in particular of poly((1-chlorodifluoromethyl)fluoromethyl acrylate), or poly(di(chlorodifluoromethyl)fluoromethyl acrylate), or poly(1,1-dihydrohepta-fluorobutyl acrylate), or poly(1,1-dihydropentafluoroisopropyl acrylate), or poly(1,1-dihydropentadecafluorooctyl)acrylate, or poly (heptafluoroisopropyl acrylate), or poly(5-(heptafluoroiso-propoxy)pentyl acrylate), or poly(11-(heptafluoroisopropoxy)undecyl acrylate), or poly(2-(heptafluropropoxy)ethyl acrylate), or poly (nonafluoroisbutyl acrylate).

Furthermore, the substance 46 of low surface energy can consist of non-fluoridated methacrylic polymers, in particular of poly(benzyl metbacrylate), or poly(n-butyl methacrylate), or poly(isobutyl methacrylate), or poly(t-butyl methacrylate) or poly(t-butylaminoethyl methacrylate), or poly(dodecyl methacrylate), or poly(lauryl methacrylate), or poly(ethyl methacrylate), or poly(2-ethylhexyl methacrylate), or poly(n-hexyl methacrylate), or poly(dimethylaminoethyl methacrylate), or poly (hydroxyethyl methacrylate), or poly(lauryl methacrylate), or poly(phenyl methacrylate), or poly(n-propyl methacrylate), or poly(stearyl methacrylate).

Furthermore, the substance 46 of low surface energy can consist of fluoridated methacrylic polymers, in particular of poly(1,1-dihydropentadecafluorooctyl methacrylate), or poly(heptafluoroisopropyl methacrylate), or poly (heptadecafluoro-octyl methacrylate), or poly(1-hydrotetrafluoroethyl methacrylate), or poly(1,1-dihydrotetrafluoropropyl methacrylate), or poly(1-hydrohexafluoroisopropyl methacrylate), or poly(t-nonafluorobutyl methacrylate), or poly(styrene-stat-2,2,3,3,-tetrafluoropropyl methacrylate).

Furthermore, the substance 46 of low surface energy can consist of polyether heteropolymers, for example of poly (oxy-ethylene-stat-oxypropylene)-block-poly (oxydimethylsilylene)-block-poly(oxyethylene-stat-oxypropylene).

Furthermore, the substance 46 of low surface energy can consist of polyimines, in particular of poly((benzoylimino) ethylene), or poly((butyrylimino)ethylene), or poly ((dodecanoyl-imino)ethylene), or poly((dodecanoyl-imino) ethylene-stat-(acetyl-imino)trimethylene), or poly ((heptanoylimino)ethylene), or poly((hexanoylimio) ethylene), or poly(((3-methyl)butyrylimino)ethylene), or poly((pentadecafluorooctadecanoylimino)ethylene), or poly ((pentanoylimino)ethylene).

Furthermore, the substance 46 of low surface energy can consist of polyurethanes, in particular of poly (methylenediphenyl-diisocyanate-alt-(butanediol poly (oxytetramethylene)diol), or poly(hexamethylene diisocyanate-alt-triethylene-glycol), or poly (4-methyl-1,3-phenylene diisocyanate-alt-tripropylene glycol).

The substance 46 can also consist of polysiloxanes, in particular poly(oxydimethyl-silylene), alpha, omega-difunctional $R—(Si(CH_3)_2—O)_n—Si(CH_3)_2—R$, or poly (oxydimethylsilylene) block copolymers.

Also, the substance 46 can consist of hydrolized and condensed organosilanes, in particular of 3-(1,1,-dihydroper-fluorooctoxy)propyltriethoxysilane, $CF_3(CF_2)_6CH_2O(CH_2)_3Si(OC_2H_5)_3$, or gammaperfluoroisopropoxypropyltrimethoxysilane, $(CF_3)_2CFO(CH_2)_3Si(OCH_3)_3$.

Finally, it is also possible to use the above mentioned polymers individually or in a mixture of two and several of the said polymers as the coating substance 46.

Figure 2:
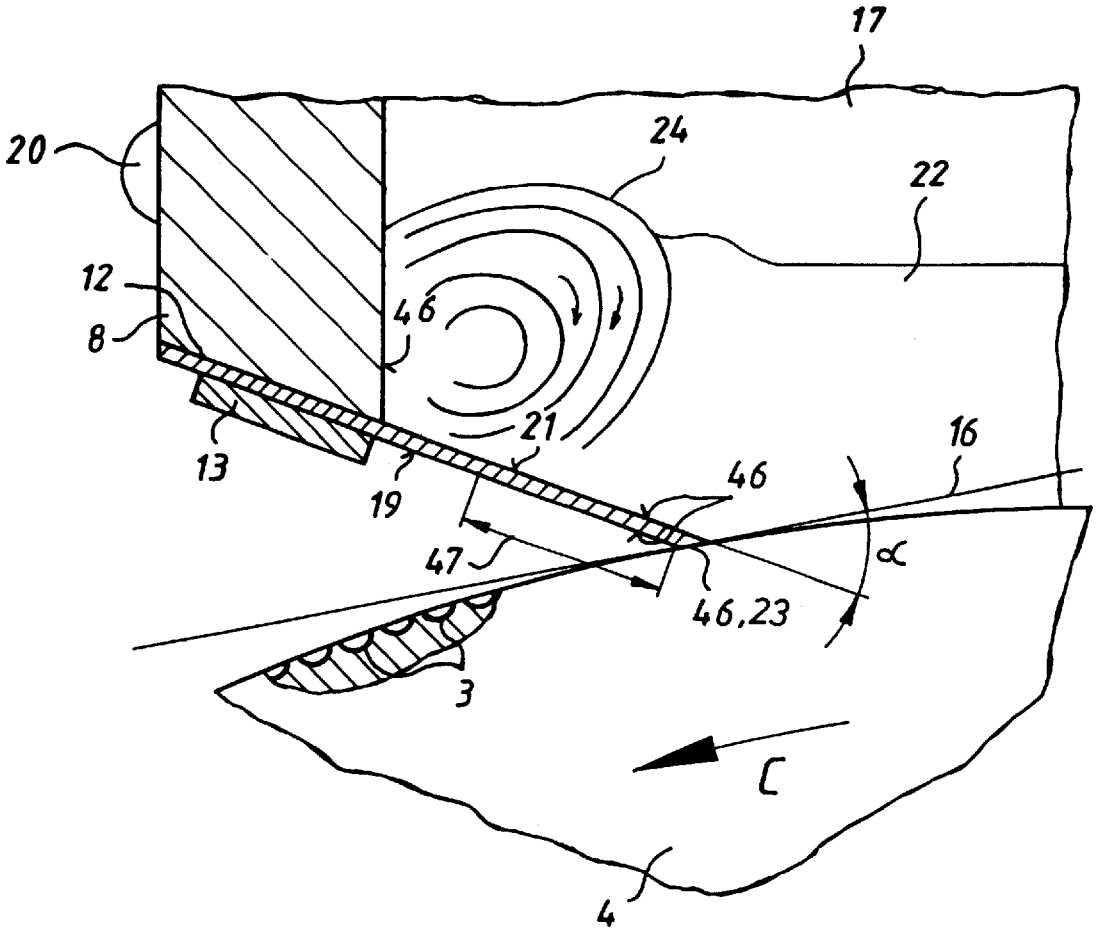

Coating with the substances 46 takes place at a thickness which, for example, lies between 0.5 and 10$\mu$m. This coating substance 46 prevents the adhesion of ink 22 on coated elements, for example in the interior of the ink duct 1. In particular, when using waterless inks of high viscosity, for example greater than 9000 mPa·s, or so-called UV inks, coating with the substances 46 can be advantageously employed, because in this case a "rotating ink roll" 24, as seen in FIG. 2, can easily be formed. By forming this "rotating ink roll" 24, an improved inking of the ink metering roller 4 is achieved.

The "ink roll" 24 is formed in the vicinity of the working doctor blade 12 and the immediately adjacent lateral wall 6 and is formed in a low-frictional manner.

As mentioned previously, a large portion of, or all of the elements of the ink duct 1 coming into contact with the ink 22 are coated with the coating substance 46.

It is, of course, also possible to place the doctor blades 11, 12 at the same angle against the ink metering roller 4.

One of the lateral walls 7, 6 is preferably angled in such a way that an opening angle $\gamma$ of approximately 90° is opened between the upper partial lateral wall 30 and the lower partial lateral wall 35. In this case, the width d of the upper partial lateral wall 30 can be equal to the width e of the lower partial lateral wall 35. However, width d can also be greater than width e and vice versa. A longitudinal axis of the ink duct 1 is identified by 45 and a vertical axis of the ink duct 1 by 48.

Preferably the ink duct 1 is pivoted, in relation to a right-angled coordinate system with the origin on the axis of rotation 5 of the ink metering roller 4, from its work position A located in the I. or II. quadrants or in the I. and II. quadrants, in relation to the position of the doctor blades 11, 12 on the ink metering roller 4 into a draining position B located in the I. and IV. quadrants, as seen in FIG. 1 or in the II. and III. quadrants in relation to the position of the doctor blades 11, 12. Thus, the ink duct 1 is pivoted out of a position, wherein the transverse axis 40 of the ink duct 1 extends horizontal or approximately horizontally, in such a way, that at the end of pivoting the transverse axis 40 of the ink duct 1 extends vertically or approximately vertically.

It is moreover possible to embody the ink duct 1 closed on the top, i.e. on its upper edge 10.

While a preferred embodiment of an ink duct in accordance with the present invention has been set forth fully and completely hereinabove, it will be apparent to one of skill in the art that a number of changes in, for example, the type of press being used, the specific type of roller used, and the like could be made without departing from the true spirit and scope of the present invention which is accordingly to be limited only by the following claims.

What is claimed is:

1. An ink duct adapted for use with an ink metering roller in a rotary printing press, said ink duct comprising;

spaced first and second lateral walls and spaced first and second end walls, said spaced first and second lateral walls and said spaced first and second end walls having inner wall surfaces forming an open, non-pressurized ink receiving chamber;

a working doctor blade secured to said first lateral wall and a closing doctor blade secured to said second lateral wall, said working doctor blade and said closing doctor blade having inner surfaces and being adapted to engage a surface of the ink metering roller of the rotary printing press;

a coating of a substance of a low surface energy on at least said inner surfaces of said working doctor blade and said closing doctor blade and said inner wall surfaces of said spaced first and second lateral side walls and said end walls of said open, non-pressurized ink receiving chamber; and, a high viscosity ink of a viscosity greater than 9000 mPa·S in said open, non-pressurized ink receiving chamber, said low surface energy coating cooperating with the ink metering roller of the rotary printing press to facilitate the intermixing and rolling of said high viscosity ink to form a rotating roll of said high viscosity ink of a viscosity greater than 9000 mPa·S rotating in said open ink receiving chamber, said rotating roll of said high viscosity ink formed in said open ink receiving chamber in the vicinity of said working doctor blade and said adjacent first lateral wall affording complete inking of the ink metering roller with which said ink duct is adapted for use.

2. The ink duct of claim 1, wherein said substance of low surface energy has a surface energy between 10 and 60 mN/m.

3. The ink duct of claim 1 wherein said substance of low surface energy is applied at a coating thickness of 0.5 to 10 $\mu$m.

4. The ink duct of claim 1 wherein said substance of low surface energy consists of a polymer.

5. The ink duct of claim 4 wherein said substance of low surface energy consists of hydrocarbon polymers.

6. The ink duct of claim 4 wherein said substance of low surface energy consists of styrene polymers.

7. The ink duct of claim 4 wherein said substance of low surface energy consists of halogen hydrocarbon polymers.

8. The ink duct of claim 4 wherein said substance of low surface energy consists of vinyl polymers.

9. The ink duct of claim 4 wherein said substance of low surface energy consists of fluoridated acrylic polymers.

10. The ink duct of claim 4 wherein said substance of low surface energy consists of non-fluoridated methacrylic polymers.

11. The ink duct of claim 4 wherein said substance of low surface energy consists of fluoridated methacrylic polymers.

12. The ink duct of claim 4 wherein said substance of low surface energy consists of polyether heteropolymers.

13. The ink duct of claim 4 wherein said substance of low surface energy consists of polyimines.

14. The ink duct of claim 4 wherein said substance of low surface energy consists of polyurethanes.

15. The ink duct of claim 4 wherein said substance of low surface energy consists of polysiloxanes.

16. The ink duct of claim 4 wherein said substance of low surface energy consists of hydrolized and condensed organosilanes.

17. The ink duct of claim 4 wherein said substance of low surface energy consists of polytetra-fluorethylene (PTFE).

18. The ink duct of claim 4 wherein said substance of low surface energy consists of a mixture of two or several polymers.

19. The ink duct of claim 1 wherein all said inner surfaces of said ink duct are coated with said substance of low surface energy.

20. The ink duct of claim 1 wherein said substance of low surface energy consists of metal-free amorphous carbon coatings ("DLC" coatings) with a highly cross-linked carbon network, on which hydrogen has been deposited.

21. The ink duct of claim 20 wherein said DLC coatings have been modified with fluorene (F-DLC).

22. The ink duct of claim 20 wherein said DLC coatings have been modified with silicon (Si-DLC).

23. The ink duct of claim 20 wherein said DLC coatings have been modified with boron (B-DLC).

24. The ink duct of claim 20 wherein said DLC coatings have been modified with nitrogen (N-DLC).

25. The ink duct of claim 20 wherein said DLC coatings have been modified with oxygen (O-DLC).

26. The ink duct of claim 1 wherein a working doctor blade and a closing doctor blade are used as said first and second ink metering elements.

27. The ink duct of claim 1 wherein adjustable ink blades are used as said ink metering elements.

28. The ink duct of claim 1 further wherein an outer surface of each of said first and second ink metering elements is coated with said substance of low surface energy.

* * * * *